US006688447B1

(12) United States Patent
Liu

(10) Patent No.: US 6,688,447 B1
(45) Date of Patent: Feb. 10, 2004

(54) ELECTRICAL ROLLING DOOR TRANSMISSION

(76) Inventor: Curtis Liu, 105, Chung Hsing Road, Lu Chu, Taoyuan Hsien (TW)

( * ) Notice: Subject to any disclaimer, the term of this patent is extended or adjusted under 35 U.S.C. 154(b) by 0 days.

(21) Appl. No.: 10/212,731

(22) Filed: Aug. 7, 2002

(51) Int. Cl.[7] ..... E06B 9/68
(52) U.S. Cl. ..... 192/139; 160/133; 160/310
(58) Field of Search ..... 192/139; 160/133, 160/310

(56) References Cited

U.S. PATENT DOCUMENTS 4,342,354 A * 8/1982 Leivenzon et al. ..... 160/133
4,372,367 A * 2/1983 Baldanello et al. ..... 160/310
4,706,727 A * 11/1987 Leivenzon et al. ..... 160/188
5,887,693 A * 3/1999 Hsu ..... 192/139
5,924,949 A * 7/1999 Fan ..... 475/149

* cited by examiner

*Primary Examiner*—Richard M. Lorence
(74) *Attorney, Agent, or Firm*—Troxell Law Office PLLC

(57) ABSTRACT

An improved electrical rolling door transmission including one door controller with one pair of transmission gears, two cams, one position cover and two adjustable shafts, all contained in the FixDisc, allowing the user to adjust manually and directly in the limited maintenance space, keeping the limiting position steady after adjustment, thus facilitates the maintenance. One positioning board is installed between the wheel and the driving motor for the user to dismantle the driving motor directly while eases maintenance and assemblage. Furthermore, several sockets on one side of the clutch disc of the FixDisc allow the inserting shaft to insert into any of these sockets for reposition, instead of waiting for reposition by revolving for a big circle, providing better reposition mechanism. While no replacement for a new clutch is needed in case of any socket being damaged, the maintenance cost generates more economic benefits.

3 Claims, 12 Drawing Sheets

ELECTRICAL ROLLING DOOR TRANSMISSION

FIELD OF THE INVENTION

The present invention relates to an improved electrical rolling door transmission, especially the one that facilitates the maintenance and assemblage.

BACKGROUND OF THE INVENTION

Please refer to FIG. 1. Traditional electrical rolling door transmission is known for its small size, small installation space and fast rolling-up capability. The door controller 1' fixed inside the FixDisc 2' with one pair of transmission gears 11' and two cams 12', 13' (as shown in FIG. 2) is the controlling mechanism for the rolling door to adjust the rolling-up position of the frame board. The two cams 12', 13' hit against the antenna 71' of the limiting position switch 7' during revolving that controls the limiting position of the frame board for the ascending and descending rolling door.

Please refer to FIG. 3. The two cams 12', 13' are installed on the transmission gear wheel 11' with a cover 14' locked on it to block and fix the two cams 12', 13', allowing them to adjust and revolve on the axis of the transmission gearwheel 11' to the limiting position of the ascending and descending door. With the friction against the side of the cover 14', the two cams 12', 13' are fixed and able to revolve along with the axis of the transmission gearwheel 11'. Therefore, after manually adjusting the limiting position of the two cams 12', 13', the cover 14' mus be relocked up so as to increase the friction of the contact area to keep the limiting position fixed and steady.

However, such positioning leaves quite small space between the FixDisc 2' and the wall, which prevents the locking tools from going through easily during assemblage or maintenance, thus hardens and disturbs the locking task and increases the assemblage or maintenance time. Moreover, the two cams 12', 13' positioned by rubbing against each other might change the limiting position of the two cams 12', 13' and results in inaccuracy during revolving when the locking screws loose up. As such, the necessity of improvement exists for the appropriateness of the traditional electrical rolling door transmission.

Besides, the assemblage of the clutch 6' for the traditional electrical rolling door transmission shown in FIG. 4 contains an adjustable inserting shaft 61' that inserts into the socket 211' of the clutch disc 21' to fix it onto the FixDisc 2', allowing the driving motor 4' to revolve on the clutch disc 21' epicyclically. In case of a power failure, the inserting shaft 61' of the clutch 6' is drawn back from the socket 211' of the clutch disc 21' to release the clutch disc 21' and revolve with the wheel 3'. Meanwhile, the driving motor 4' and the clutch disc 21' become a linked mechanism, allowing the wheel 3' to spin on the reel, enable the user to open and close the rolling door easily and rapidly.

The socket 211' by which the inserting shaft 61' of the above clutch 6' is inserted and the inserting shaft 61' make a pair; therefore, to re-insert the inserting shaft 61', the socket 211' of the clutch disc 21' must be repositioned to correspond to the inserting shaft 61' and allow it to get stuck automatically. Because the correspondence of the single socket 211' by revolving is difficult to implement and any damage to the socket 211' requires a replacement of the entire clutch disc 21', which is a waste of money and an increase of maintenance and assemblage time, as such, the single socket design of the clutch 6' for the electrical rolling door transmission is a burden for operation and conflicts with economic benefits.

Please refer to FIG. 5 for the assemblage of the driving motor of traditional electrical rolling door transmission. The driving motor is fixed onto the wheel 3' of the rolling-up frame board. With the clench between the gearwheel on the reel of the wheel and the inner ring gearwheel of the clutch disc 21' of the FixDisc 2', the driving motor 4' is able to revolve on the clutch disc 21' epicyclically, driving the wheel 3' to revolve. Besides, when the driving motor 4' is fixed onto the wheel 3', the limited space between the clutch disc 21' and the wheel 3' restricts the screw 5' to be bolted outwardly to the driving motor 4' from between the clutch disc 21' and the wheel 3' and fixes the driving motor 4' onto the wheel 3'. During the maintenance or renewal, however, the whole wheel 3' must be dismantled before taking off the driving motor 4', causing great inconvenience in maintenance and assemblage as well as a waste of manpower.

SUMMARY OF THE INVENTION

The main objective of the present invention is to provide an improved electrical rolling door transmission, in which the two cams of the door controller are designed as the inner gearwheel and the outer gearwheel clenching against each other for adjustment, rather than through the traditional positioning by friction. Thus, even in such small space for the maintenance, the mechanism can be adjusted manually with the user's fingers. The clench positioning of the adjusted gearwheel keeps the limiting position of the two cams steady, thus facilitates the adjustment and maintenance of the rolling-up position of the frame board.

Another objective of this present invention is to eliminate the time of waiting for reposition after revolving for a big circle by providing several sockets on the clutch disc that allow the inserting shaft of the clutch to be positioned randomly into any of the socket, contributing to the operation of reposition What's more, in case of any damaged socket, it is not necessary to replace the whole clutch disc as other sockets are available, thus provides more economic benefits in maintenance.

Another objective for the present invention is that, by installing a positioning board between the driving motor and the wheel for the screws to be fastened on the wheel directly through the positioning board and bolting the screw with the locking board of the driving motor with screw nuts, the user can dismantle the driving motor directly without the necessity of detaching the wheel, thus makes the operation more easily and convenient.

In the following, the embodiment illustrated is used to describe the detailed structural characteristics and operation action for the present invention.

DETAILED DESCRIPTION OF THE INVENTION

Figure 1:
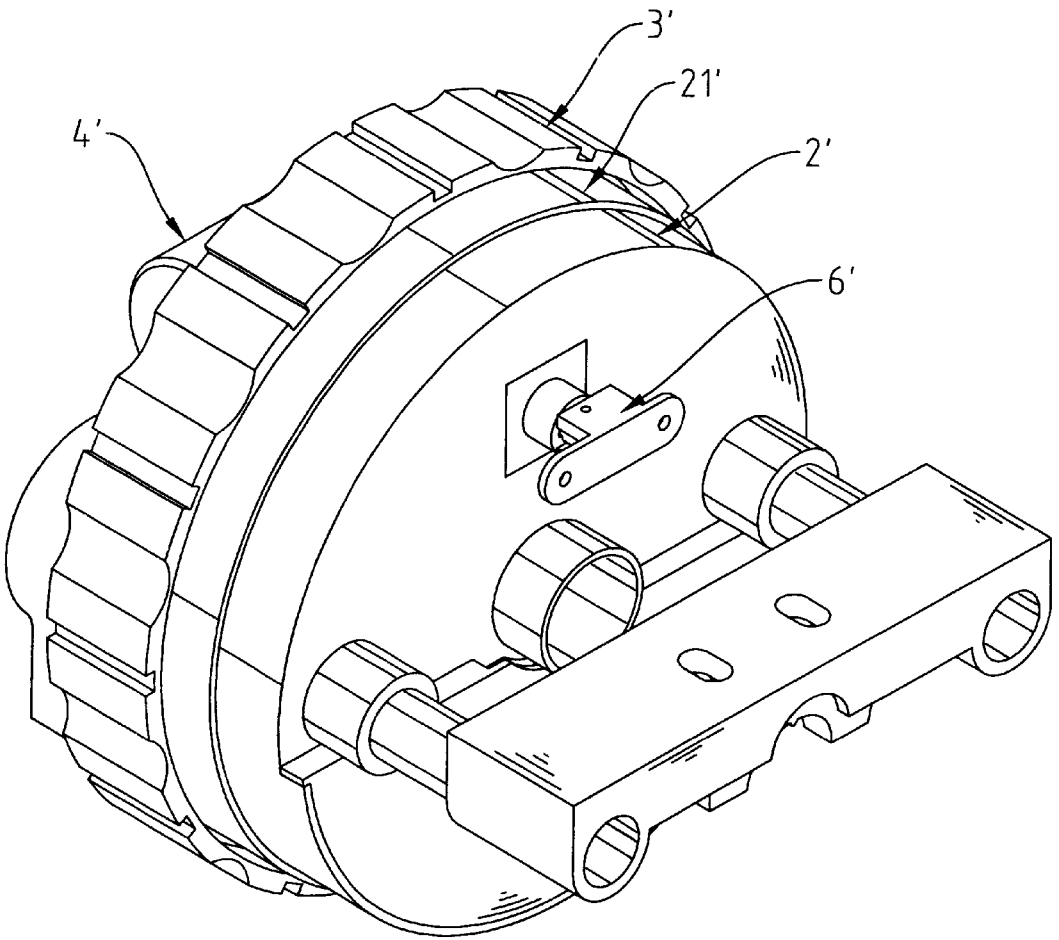
FIG. 1 Prior Art
FIG. 1 is the diagram about the appearance of traditional electrical rolling door transmission.
Figure 2:
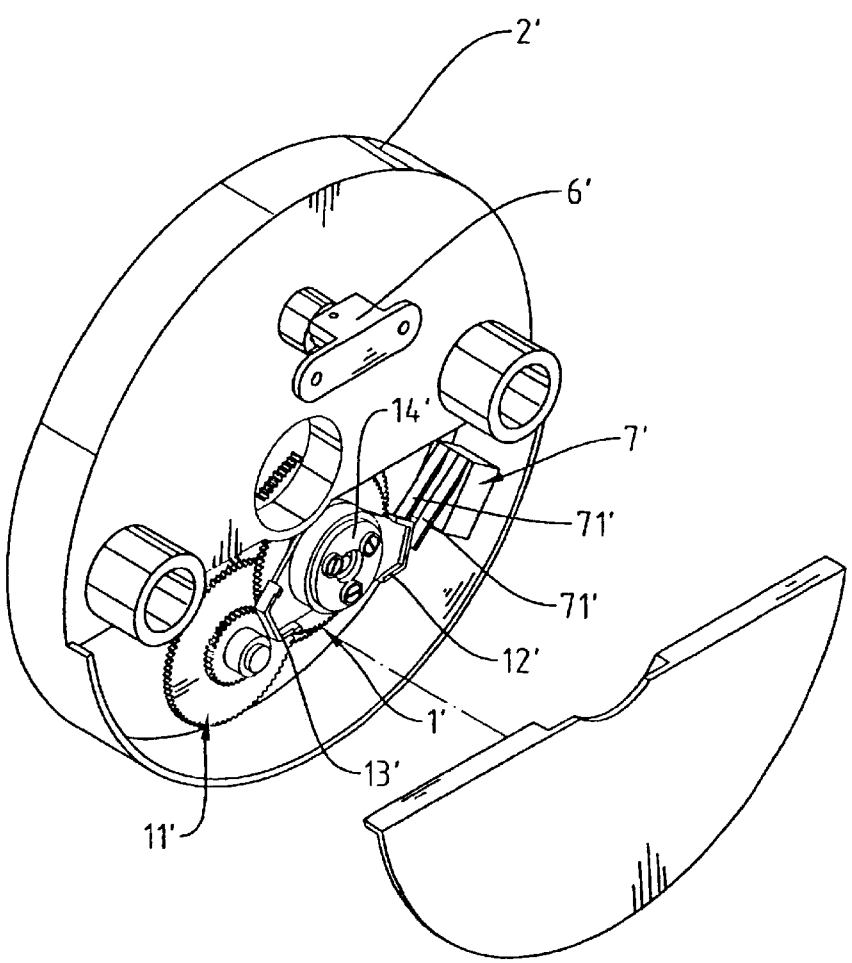
FIG. 2 Prior Art
FIG. 2 is the diagram about the appearance of the door controller for traditional electrical rolling door transmission.
Figure 3:
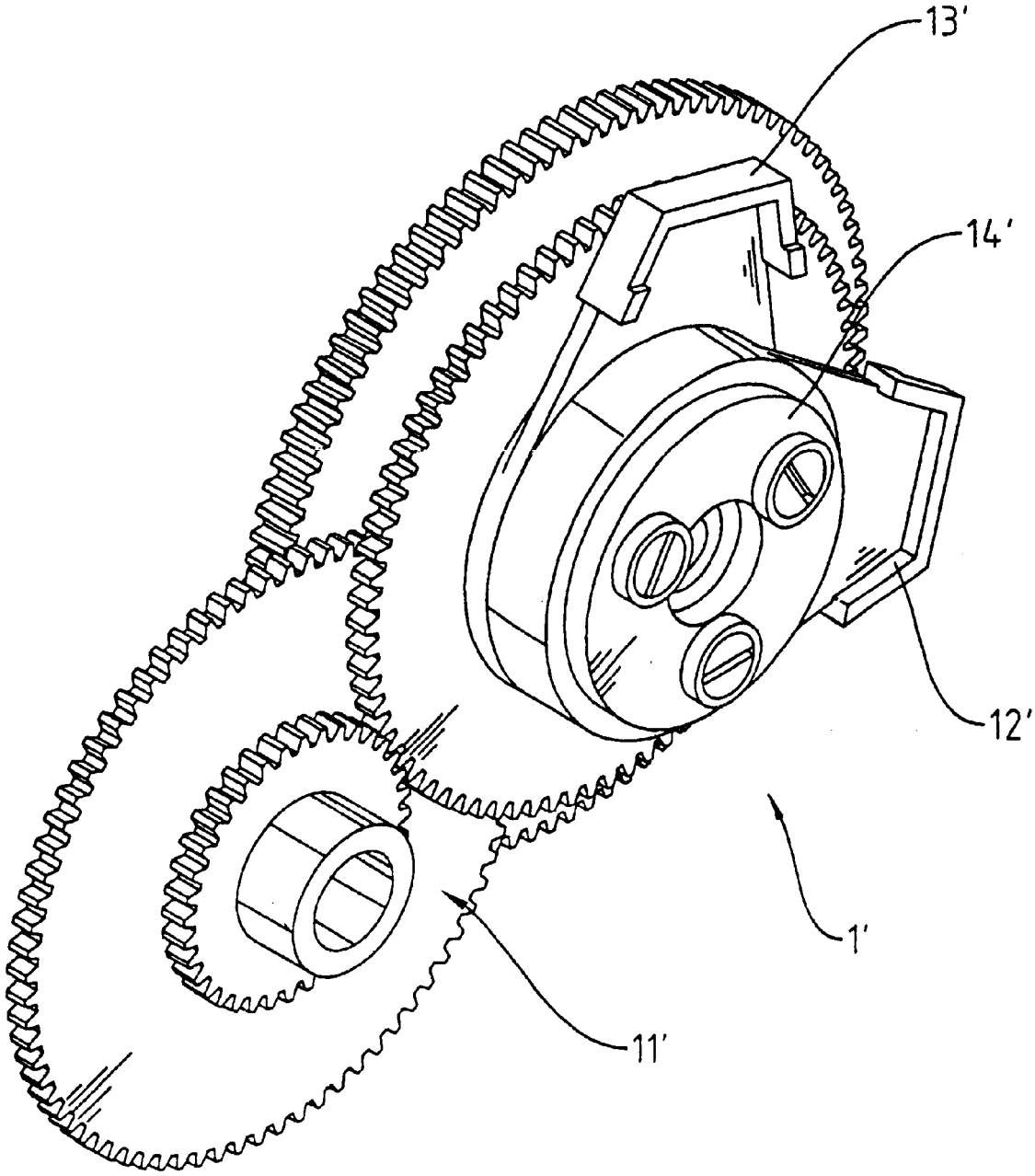
FIG. 3 Prior Art
FIG. 3 is the diagram about the assemblage of traditional door controllers.
Figure 4:
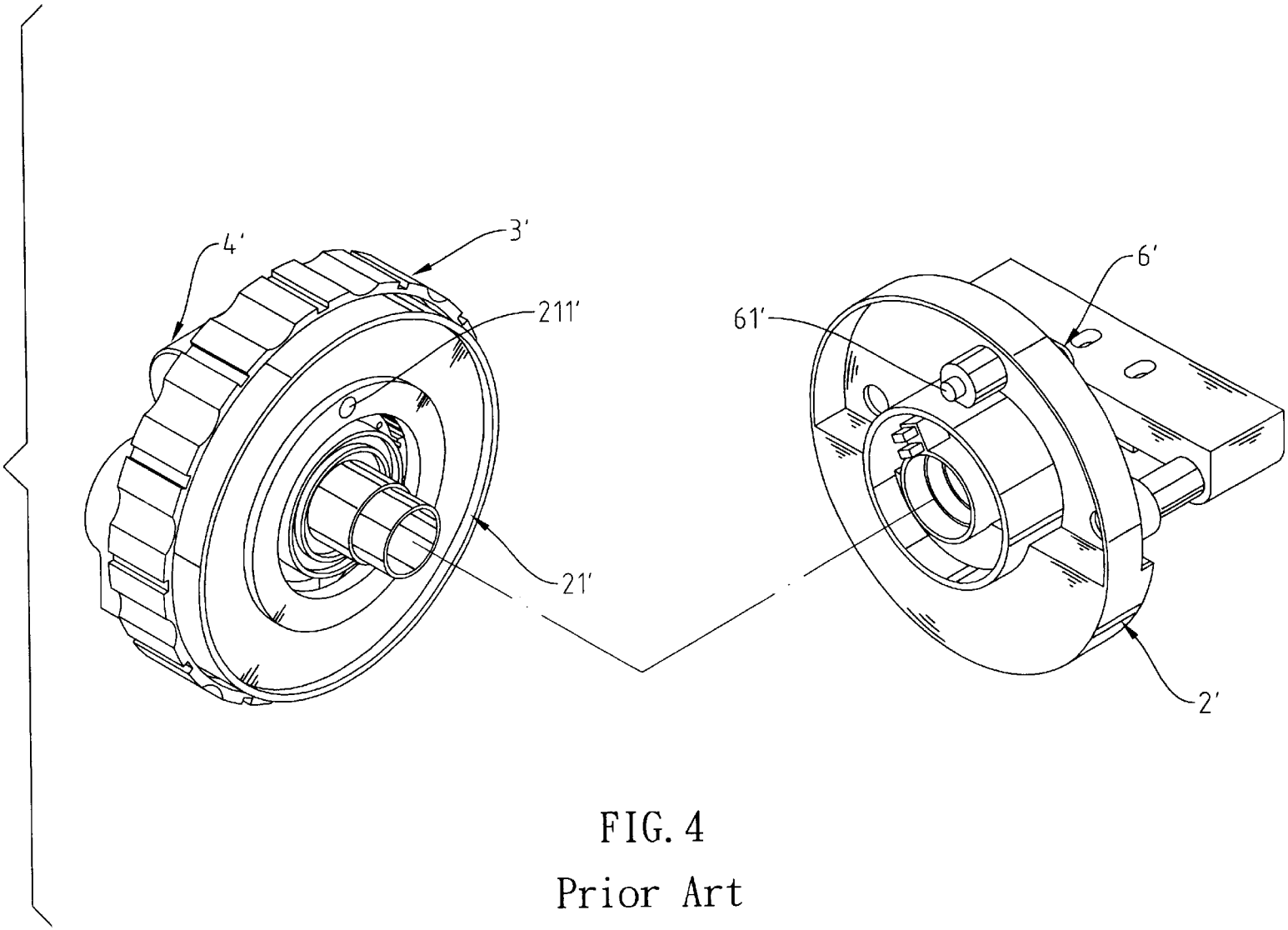
FIG. 4 Prior Art
FIG. 4 is the diagram about the assemblage of the clutch for traditional electrical rolling door transmission.
Figure 5:
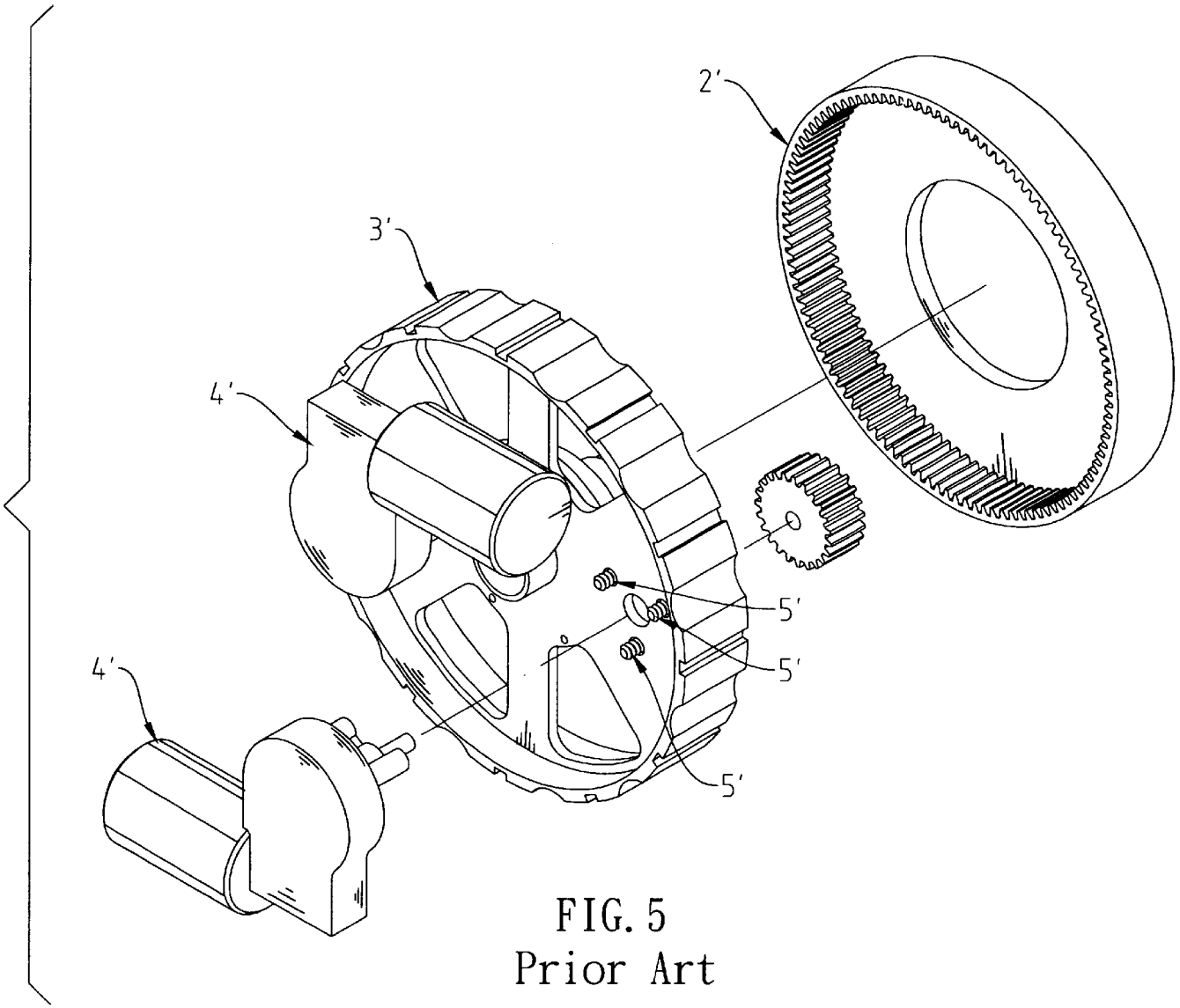
FIG. 5 Prior Art
FIG. 5 is the diagram about the assemblage of the driving motor for traditional electrical rolling door transmission.
Figure 6:
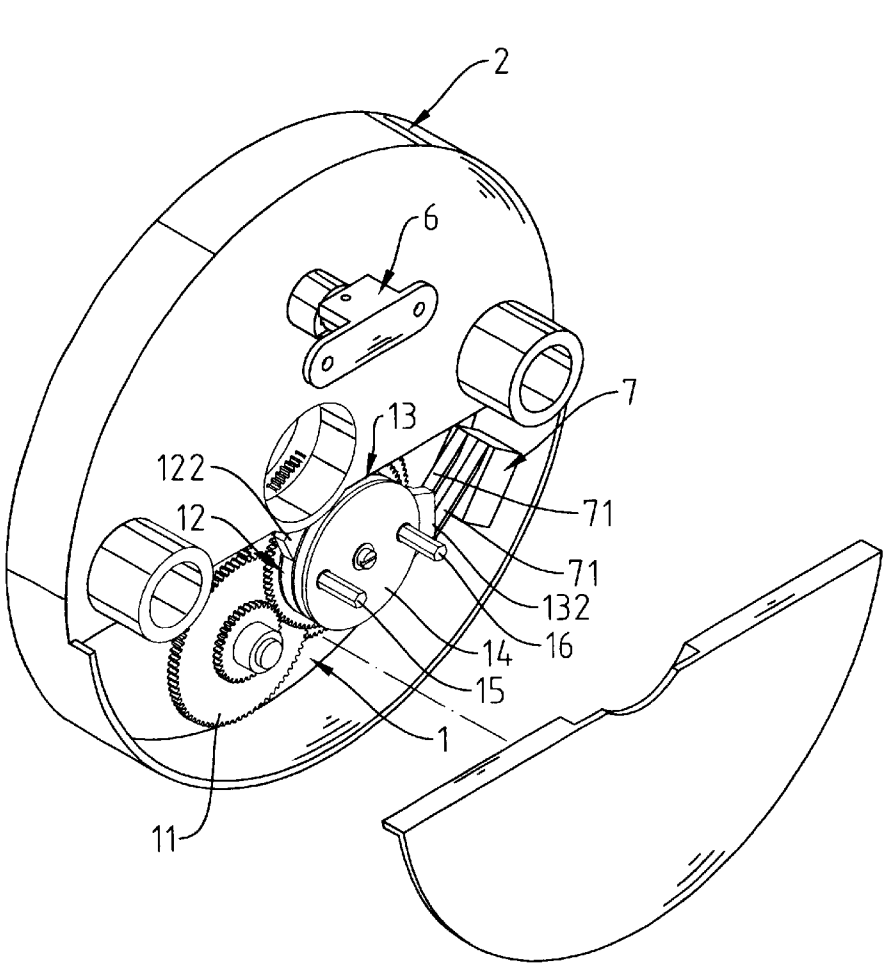
FIG. 6 is the diagram about the appearance of the door controller of the electrical rolling door transmission for the present invention.
Figure 7:
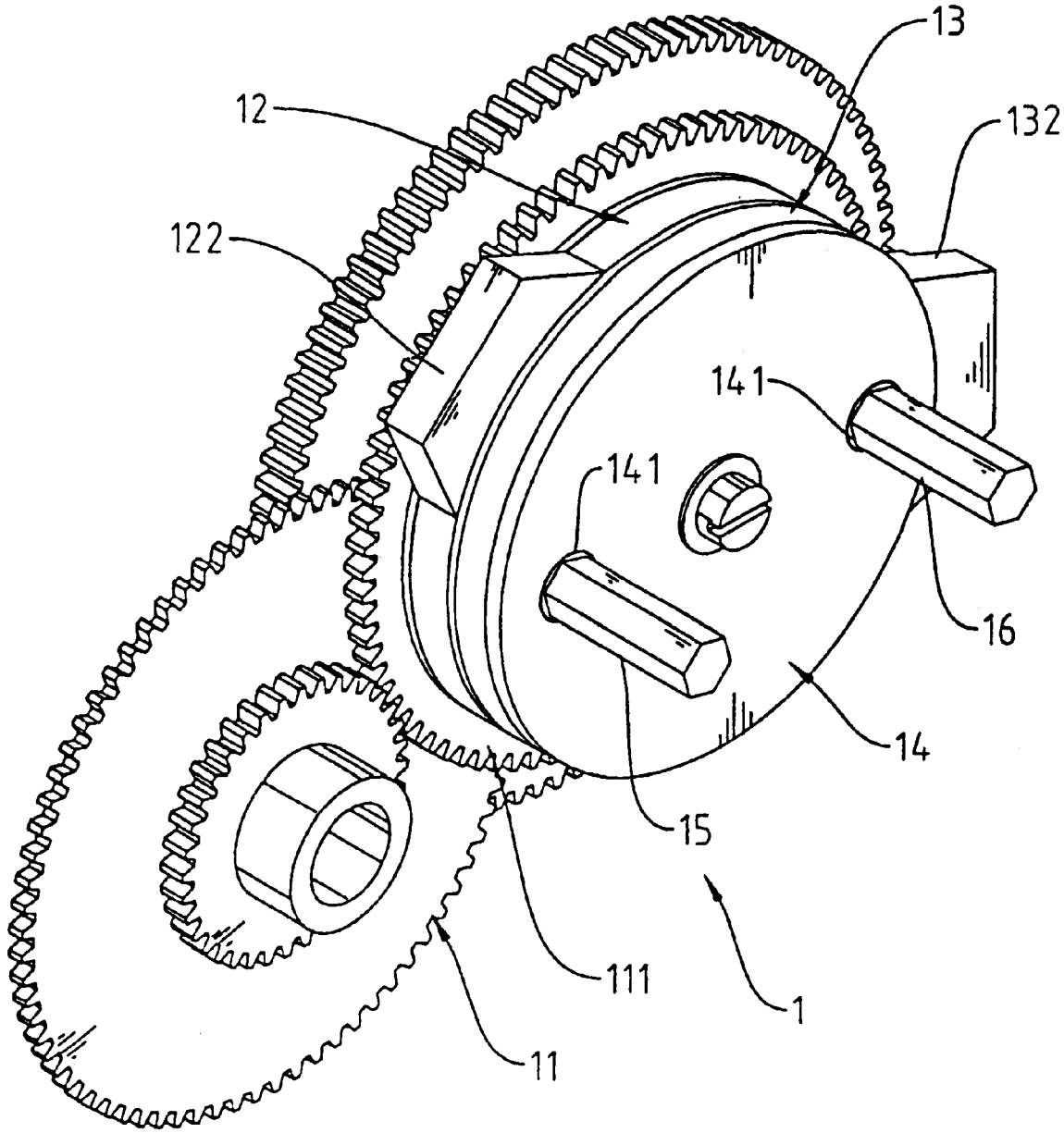
FIG. 7 is the diagram about the assemblage of the door controller for the present invention.
Figure 8:
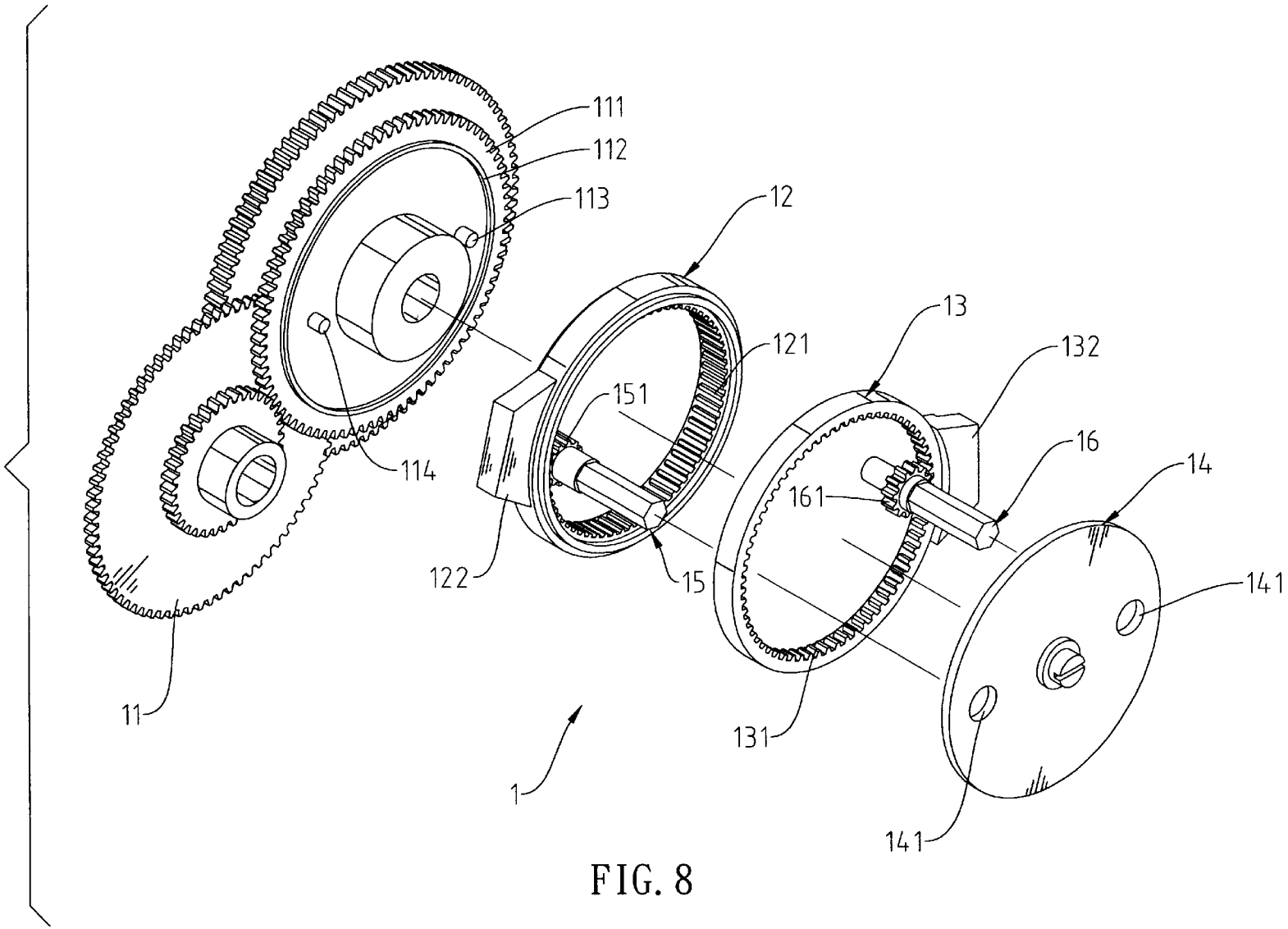
FIG. 8 is the diagram about the component decomposition of the door controller for the present invention.

Please refer to FIG. 6 to FIG. 9. Fixed on the inner side of the FixDisc 2, the door controller 1 of the electrical rolling door transmission for the present invention contains one pair of transmission gearwheel (11), two cams 12, 13, one positioning cover 14 and two adjustable shafts 15, 16. On the external edge of the low-speed gearwheel 111 of the transmission gearwheel 11 set a flange ring 112 within which a pair of raised pillars 113, 114 sit correspondingly to each other, allowing the two polygonal adjustable shafts 15, 16 to be slipped on for revolving. An external gearwheel 151 is installed at the bottom of the adjustable shaft 15 and another external gearwheel 161 the middle of the adjustable shaft 16. The two cams 12, 13, one small ring and one big ring, are equipped with the inner toothed rings 121, 131 around the inner edge. A barricade 122, 132 protruding from the external edge of the two cams 12, 13 touches the two antennas 71 of the limiting switch 7 when revolving, thus controls the limiting position of the ascending and descending door.

The above cam 12 whose inner toothed ring 121 clenching against the external gearwheel 151 of the adjustable shaft 15 is equipped inside the flange ring 112 of the low-speed gearwheel 111. A fillister 133 exists between the cams 12, 13, allowing the cam 13 to be connected on the cam 12 with its inner toothed ring 131 clenching against the external gearwheel 161 of the adjustable shaft 16, thus the exterior of the cam 13 is positioned on the positioning cover 14 driven by the axis of the low-speed gearwheel 111, enabling the cams 12, 13 to be steadily fixed and positioned on the low-speed gearwheel 111 for revolving. Furthermore, the positioning cover 14 set with the holes 141 corresponding to the adjustable shafts 15, 16 allows the polygonal part of the adjustable shafts 15, 16 to expose outside the positioning cover 14 for the maintenance worker to revolve.

Figure 9:
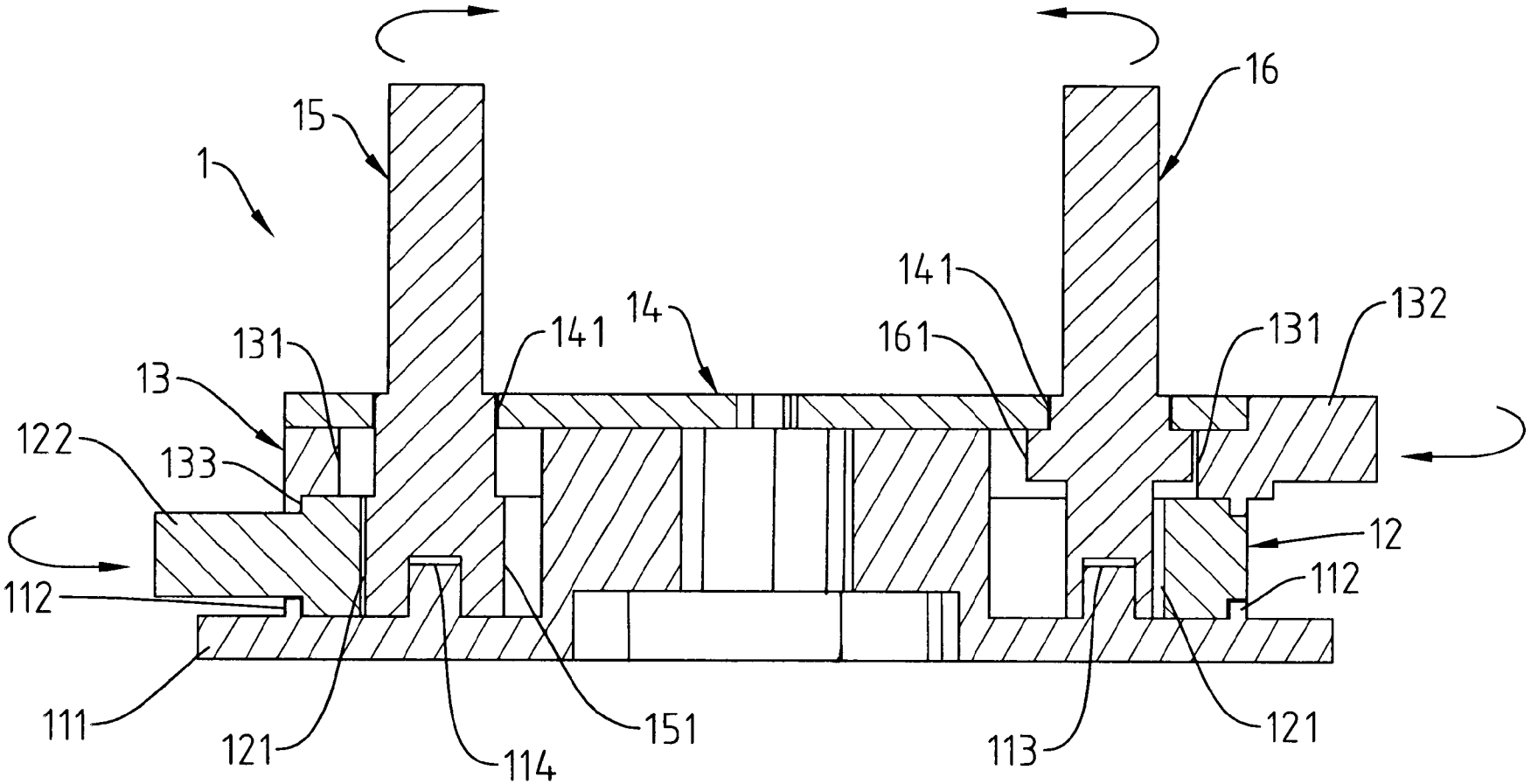
FIG. 9 is the diagram about the revolving operation of the door controller for the present invention.

Please refer to FIG. 9. In an attempt to adjust the limiting position of the ascending and descending door, the maintenance worker simply revolves the two adjustable shafts 15, 16 that adjust and control the inner toothed rings 121, 131 with the clenched external gearwheel 151, 161 of the adjustable shafts 15, 16, thus enable the two cams 12, 13 to revolve within the configured limit positions. In this way, the maintenance can be implemented simply by manually adjusting the two cams 12, 13 with fingers through the small space. After adjustment and positioning, the external gearwheel 151 of the two adjustable shafts 15, 16 and the inner toothed rings 121, 131 of the two cams 12, 13 are kept clenched against one another, preventing the limiting positions of the cams 12, 13 from changing because of external factors, thus eases the adjustment and maintenance for the rolling-up position of the frame board.

Figure 10:
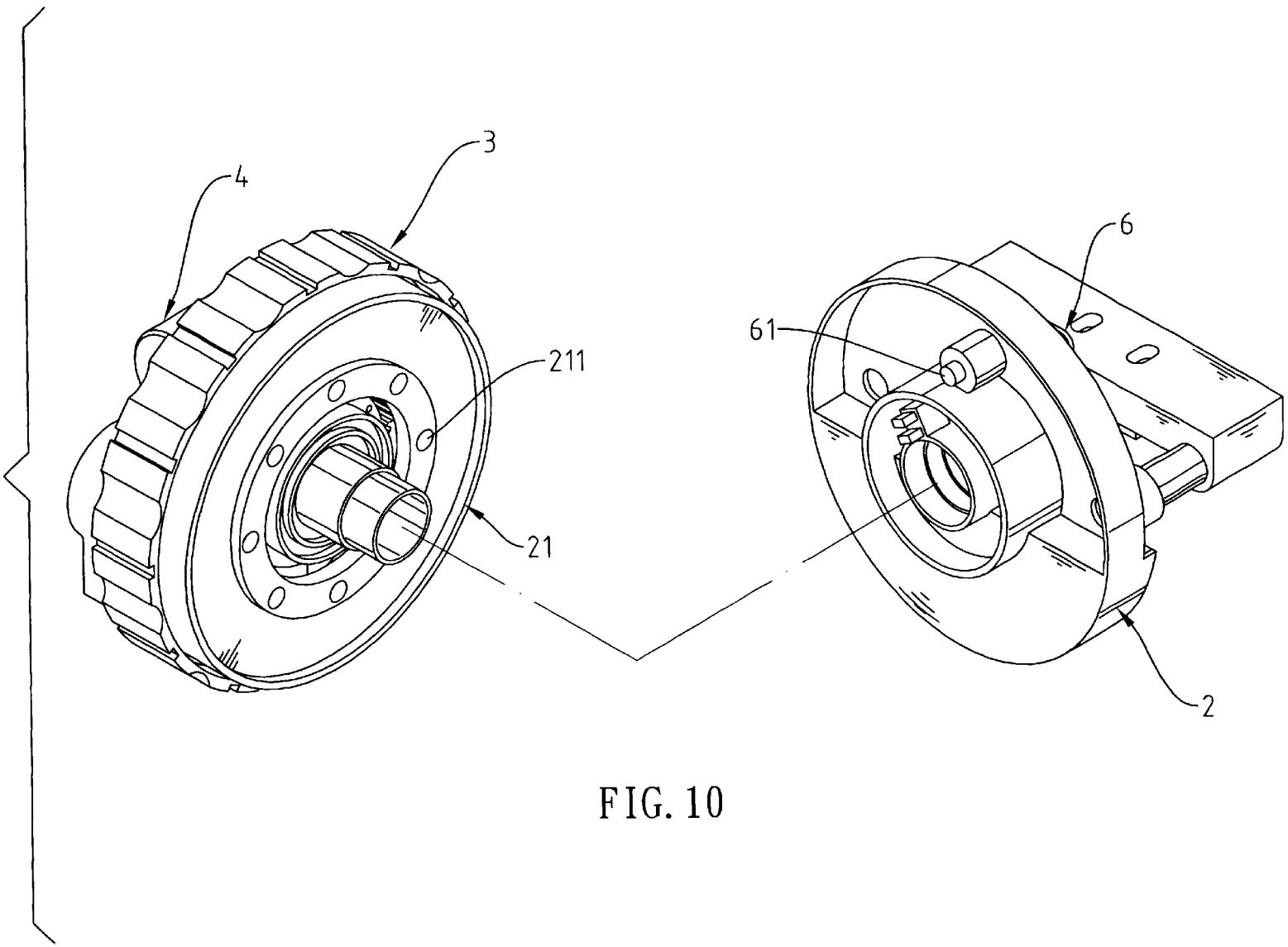
FIG. 10 is the diagram about the decomposition of the clutch of the electrical rolling door transmission for the present invention.

Please refer to FIG. 10. The clutch 6 of the electrical rolling door transmission for the present invention is equipped with an adjustable shaft 61 fixed on the FixDisc 2. Several sockets 211 at equal distances are installed on the side of the clutch disc 21, allowing the inserting shaft 61 of the clutch 6 to be inserted. By inserting the inserting shaft 61 into any one of the sockets 211, the clutch disc 21 is fastened onto the FixDisc 2, allowing the driving motor 4 to revolve epicyclically on the clutch disc 21 and push the wheel 3 to roll up the frame board.

In case of a power failure, the inserting shaft 61 of the clutch 6 is shrunk from the socket 211, departing the clutch disc 21' from the FixDisc 2 and revolving with the wheel 3. Meanwhile, the driving motor 4 and the clutch disc 21 become a linked mechanism that allows the user to open and close the rolling door easily and rapidly.

Furthermore, with the several sockets on the clutch disc 21, inserting shaft 61 of the clutch 6 can insert into any of these sockets, eliminating the time of waiting for reposition after revolving for a big circle, contributing to more efficient reposition. While no replacement for the entire clutch disc 21 is needed in case of any socket being damaged, the maintenance cost brings forth more economic benefits.

Figure 11:
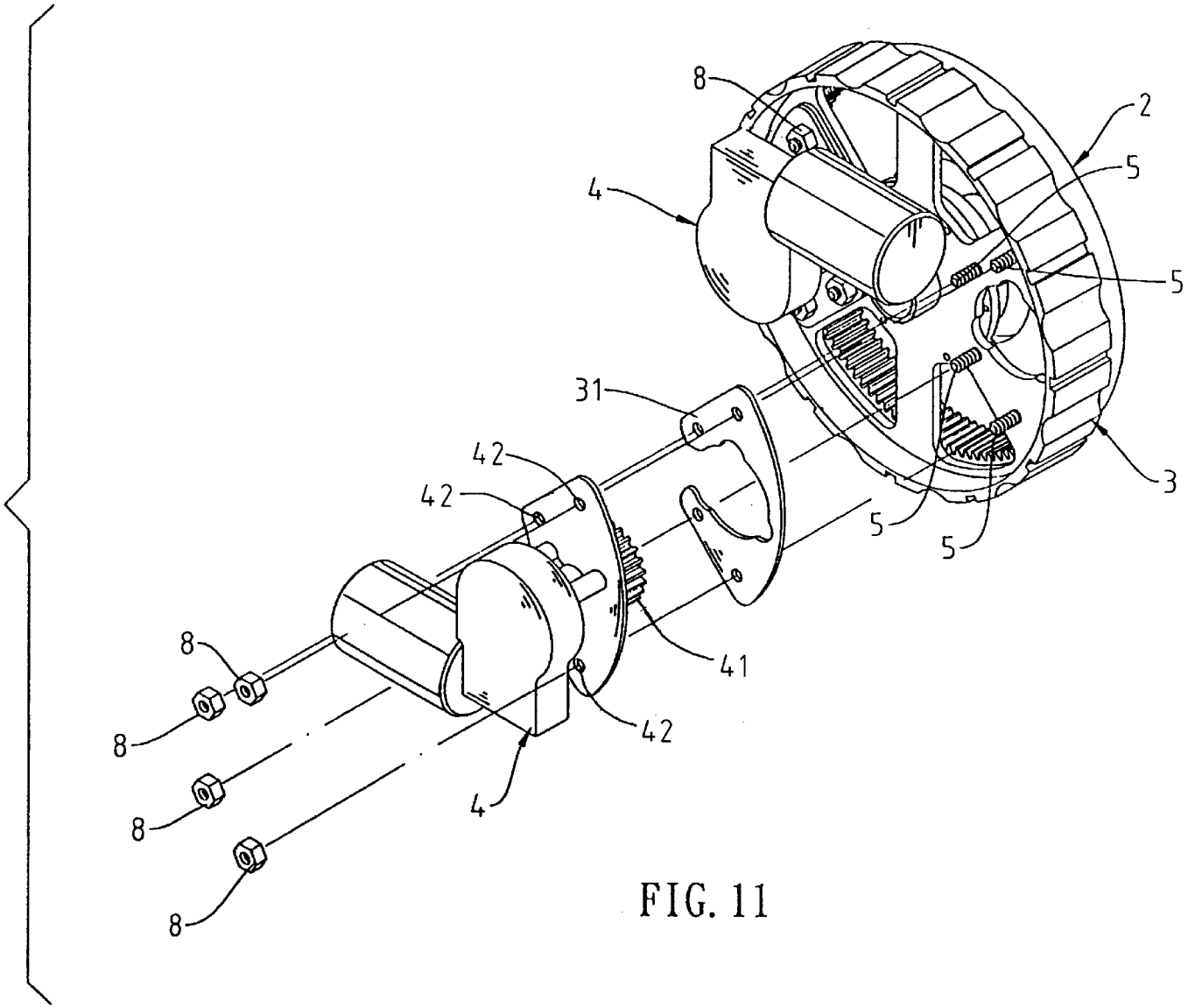
FIG. 11 is the diagram about the decomposition of the driving motor and the positioning board of the electrical rolling door transmission for the present invention.

Please refer to FIG. 11. To provide more convenience in the maintenance and assemblage of the electrical rolling door transmission, a positioning board 31 is installed between the driving motor 4 and the wheel 3 of the rolling frame board. With the positioning board 31, the screws 5 locked up on the wheel 3 can pass through the positioning board 31 for fixture. The screws 5 fixed on the wheel 3 pass through the hole 42 on the locking board of the driving motor 4 and bolt with the screw nut 8, fastening the driving motor 4 up the wheel 3. Therefore, the driving motor 4 can be dismantled directly during maintenance, without the necessity of dismantling the wheel 3, providing more convenience for maintenance. Besides, the addition of the positioning board 31 enhances the strength, allowing the driving motor 4 to move in epicyclically on the clutch disc 21 by the clenching of the transmission gearwheel 41 on the axis and the inner toothed ring inside the clutch disc 21 of the FixDisc 2, thus pushes the wheel 3 to revolve.

Figure 12:
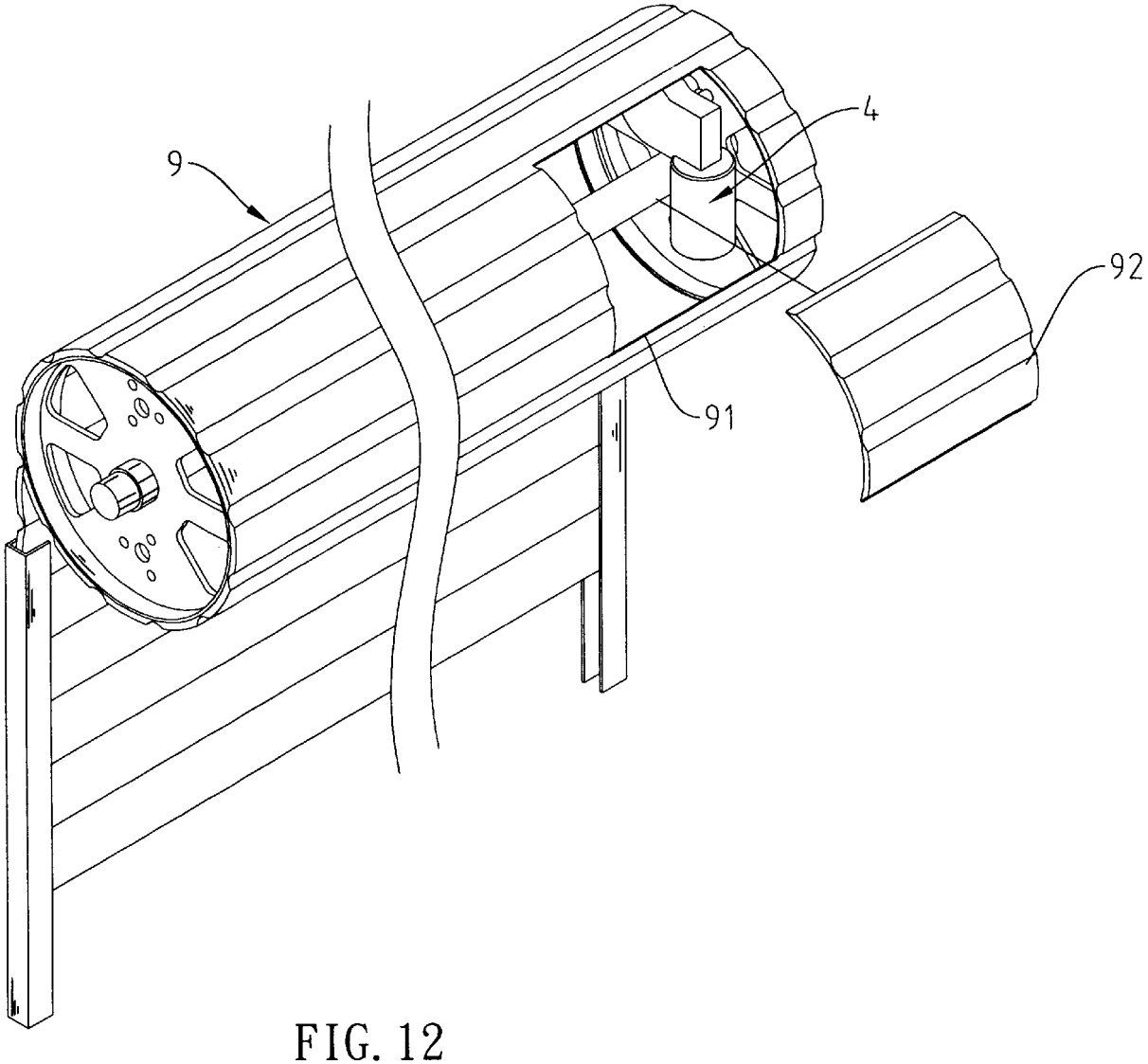
FIG. 12 is the diagram about the decomposition of the detachable rolling frame board on the driving motor of the electrical rolling door transmission for the present invention.

Please refer to FIG. 12. A maintenance hole 91 corresponding to the concealed driving motor 4 is set on the rolling frame board 9 in order to facilitate the maintenance and assemblage for the driving motor 4. The detachable rolling frame board 92 on the maintenance bole 91 completes and facilitates the maintenance and assemblage of the electrical rolling door transmission.

What is claimed is:

1. An improved electrical rolling door transmission, having one door controller inside one FixDisc with one pair of transmission gearwheel, two cams, one positioning cover and two adjustable shafts, characterized in that:

there is one flange ring on a low-speed gearwheel of said transmission gearwheel, within said transmission gearwheel a pair of raised pillars sit correspondingly to each other for said two adjustable shafts to slip on for revolving, a top of said two adjustable shafts is shaped as polygon with an external gearwheel fitted at bottom of each adjustable shaft;

an inner toothed ring circles around inside said two cams, a barricade protrudes outward from each said cam, hitting against two antennas of a limiting switch, one said cam is fitted inside said flange ring of said low-speed gearwheel with said inner toothed ring clenching against said external gearwheel on one said adjustable shaft, a fillister exists between said two cams, connecting them together, said toothed inner ring for other said cam clenches against external gearwheel of other adjustable shaft, said two cams fixedly steadily by said positioning cover are positioned on said low-speed gearwheel for revolving;

furthermore, two holes are bored through said positioning cover in correspondence with said adjustable shafts for them to expose out of said positioning cover, allowing a maintenance worker to revolve and adjust limiting positions for said two cams.

2. The improved electrical rolling door transmission of claim 1, wherein a positioning board is installed between a driving motor and a wheel for screws fastened on said wheel to pass directly through said positioning board and be bolted with screw nuts, thus contribute to dismantling said driving motor fastened with screws and screw nuts.

3. The improved electrical rolling door transmission of claim 1, wherein there are several sockets at equal distances on a clutch disc of said FixDisc that allow an inserting shaft of said clutch to insert and thus fixes said clutch disc.

* * * * *